United States Patent [19]

Maier et al.

[11] Patent Number: 4,905,421

[45] Date of Patent: Mar. 6, 1990

[54] DISK GRINDING (SANDING) MACHINE

[76] Inventors: Peter Maier, Gerokstrasse 1, 7311 Neidlingen; Karl Attinger, Seestrasse 21, 7311 Holzmaden; Wolfgang Kuch, Finkenweg 4, 7311 Neidlingen, all of Fed. Rep. of Germany

[21] Appl. No.: 353,153

[22] Filed: May 15, 1989

Related U.S. Application Data

[63] Continuation of Ser. No. 222,116, Jul. 20, 1988, abandoned.

[30] Foreign Application Priority Data

Jul. 20, 1987 [DE] Fed. Rep. of Germany ..... 3723947
Feb. 25, 1988 [DE] Fed. Rep. of Germany ..... 3805991

[51] Int. Cl.[4] ..... B24B 23/00
[52] U.S. Cl. ..... 51/170 T
[58] Field of Search ..... 51/170 T, 170 MT, 170 R, 51/272, 273

[56] References Cited

U.S. PATENT DOCUMENTS 3,334,448 8/1967 Alexander ..... 51/170 T
3,673,744 7/1972 Oimoen ..... 51/170 T
3,882,644 5/1975 Cusumano ..... 51/170 T
4,683,682 8/1987 Pennison ..... 51/170 R
4,765,099 8/1988 Tanner ..... 51/170 T

FOREIGN PATENT DOCUMENTS 3512190 10/1986 Fed. Rep. of Germany .... 51/170 T

*Primary Examiner*—Judy Hartman
*Attorney, Agent, or Firm*—McGlew & Tuttle

[57] ABSTRACT

A disk grinding machine includes a grinding disk (5*a*), driven by a driving shaft. A handle projects laterally out of a machine housing and is covered by the machine housing. A dust suction installation with a suction hood is provided which covers the upper side of the grinding disk and overlaps its circumference. The installation contains a suction chamber having a bristle rim at its lower end which is fastened to the machine housing. The bristle rim extends only over a part of the circumference of the suction hood. The grinding dust is picked up through the area between the circumference of the grinding disk and the bristle rim and to the suction chamber (11*a*). The upper part of the suction hood is connected to the machine casing and a lower part of the hood is disposed pivotally and independent from the grinding disk and it supports a bristle rim. A handle for the machine comprises a control grip which is in a driving connection with the lower part of the hood through a drive.

17 Claims, 7 Drawing Sheets

DISK GRINDING (SANDING) MACHINE

This is a file-wrapper-continuation application of application Ser. No. 222,116 filed July 20, 1988 now abandoned.

BACKGROUND OF THE INVENTION

Field of the Invention

This invention relates in general to a grinding device, and in particular to a new and useful hand held grinding machine, which includes a rotary grinding disk covered by a suction hood for removing grinding dust. The suction hood includes a rim portion depending below the grinding disk which defines a dust screening surface which extends around only a part of the periphery of the disk.

The invention relates particularly to a disk grinding machine fashioned as a hand operated instrument. It includes a grinding disk, driven into a rotation movement by a driving shaft. A handle of the machine spreads away laterally into a drive machine casing. The casing includes a dust exhauster with a suction hood which is attached to the machine casing and covers the upper side of the grinding disk and defines a suction chamber having a bristle rim extending towards the work piece only over a part of the circumference of the suction hood, leaving a part of the visual range free. The grinding dust is brought through between the circumference of the grinding disk and the bristle rim. By means of such a disk grinding machine the place of grinding treatment is visible if the disk grinding machine is held so that the work area of the grinding disk is free from the bristle rim. Prior to the invention, working conditions, or the shape of the work piece made visual observation impossible. Even if conditions allowed the work piece to be treated by the area of the grinding disk, which is not covered by the bristle rim, a disadvantage remained. Prior to the invention it was frequently necessary to provide a distance between the local treating unit and the beginning of the bristle rim so that the dust, which is slipped away tangentially is not caught in the bristle rim, but passes it and thus will not be exhausted.

SUMMARY OF THE INVENTION

The present invention provides a disk grinding machine which renders it possible to treat the work pieces independently from a bristle rim without affecting dust exhausting.

According to the invention a suction hood surrounding a grinding disk includes a bristle rim attached to an upper piece forming a dust suction machine casing formed as a handle which is a housing having a drive motor with a driving connection for the grinding disk.

Thus, the circumference of the grinding disk is covered by the bristle rim or something similar. Since the bristle rim can be formed together with the lower part of the hood around the grinding disk, it can be oriented into the circumference position where the dust is generated, so that the grinding disk can be applied on the work piece in an optional position and a good dust suction is always obtained. The bristle rim, or something similar, can be shifted in the direction opposite to the direction of rotation of the grinding disk so closely to the respective place of treatment, that the grinding dust, which is swept away tangentially comes through between the bristle rim and the circumference of the grinding disk to the suction space. In the course of this, the place of treatment is visible and a further advantage is obtained, with the grinding plate work piece joints can be reached with virtually each area of the circumference of the grinding disk, and the bristle rim.

The disk grinding machine is held at the handle which spreads away laterally. The handle which is in a driving connection with the lower part of the hood, is fashioned as a control grip and holds a drive motor which is held and guided. The housing has a bristle rim which can be adjusted during the treatment of the work piece, without releasing the handle. Thus, the grinding machine can be held in different positions in relation to the work piece without interrupting the guiding process, and in the course of this the bristle rim can be guided in such a way, that it always starts next to the momentary place of treatment. Without this measure the machine would have to be lifted from the work piece in order to twist the lower part of the hood, and it would be necessary to hand reach to the lower side of the hood into the area of the grinding disk. This would be dangerous and would involve greater expense Also, since such machines are generally held with both hands the second hand would not be available for such a maneuver.

Accordingly, it is an object of the invention to provide an improved disk grinding machine which includes a rotatable disk having a suction hood positioned over the disk which includes a rim portion which extends downwardly in front of the disk at a spaced location therefrom, and which provides a screening area for dust which extends only partly around the disk leaving a portion which is visible for observation of the work piece.

A further object of the invention is to provide a grinding machine in which the rotatable grinding disk is supported on a handle member having a driving motor therein connected to drive the disk and which includes another handle member for facilitating the positioning of a dust hood by hand, and which has a gear drive to the suction hood.

A further object of the invention is to provide a grinding machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

GENERAL DESCRIPTION OF THE PREFERRED EMBODIMENTS

Figure 1:
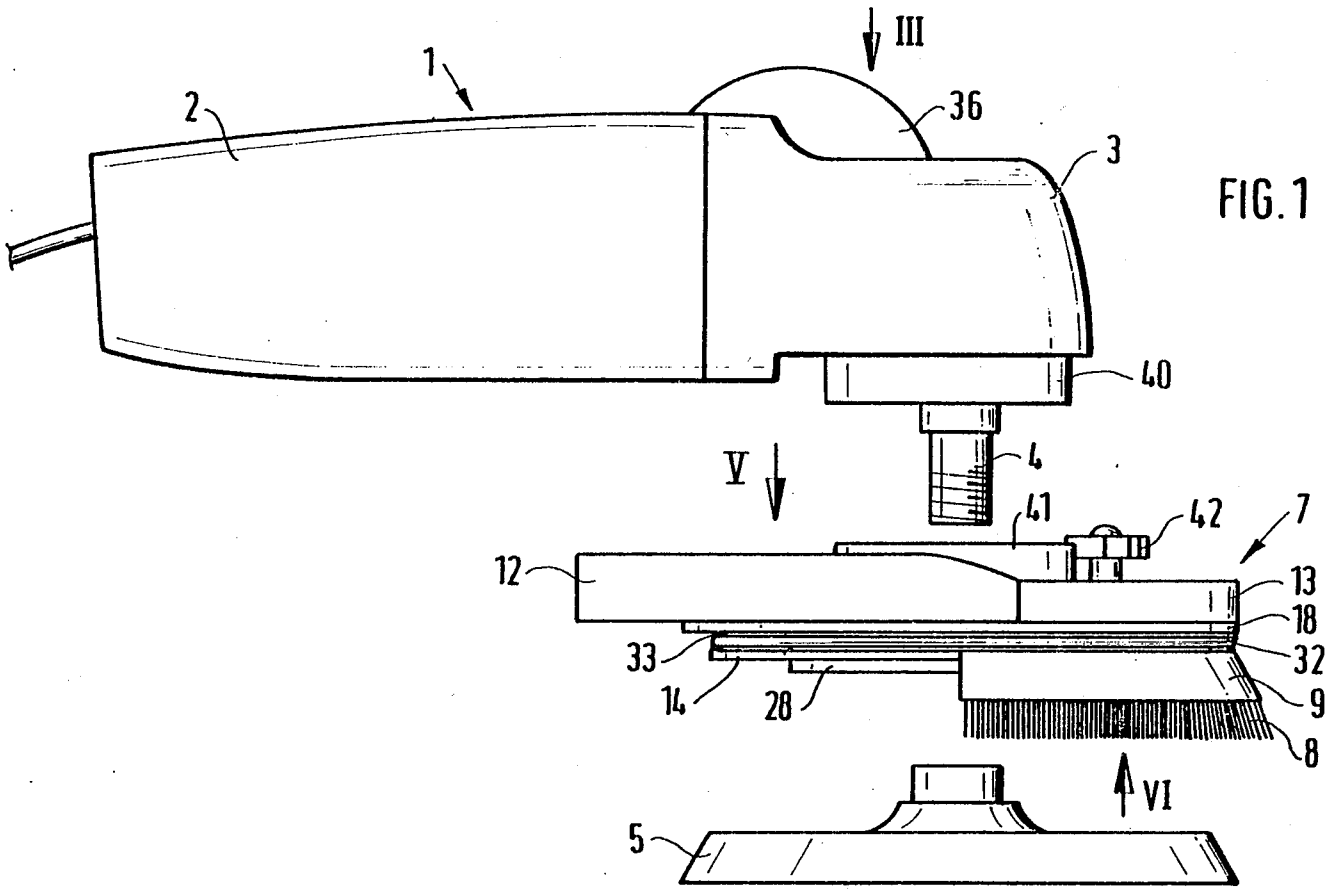
FIG. 1, is an exploded side elevational view of an inventive disk grinding machine according to arrow I in FIG. 3.
Figure 2:
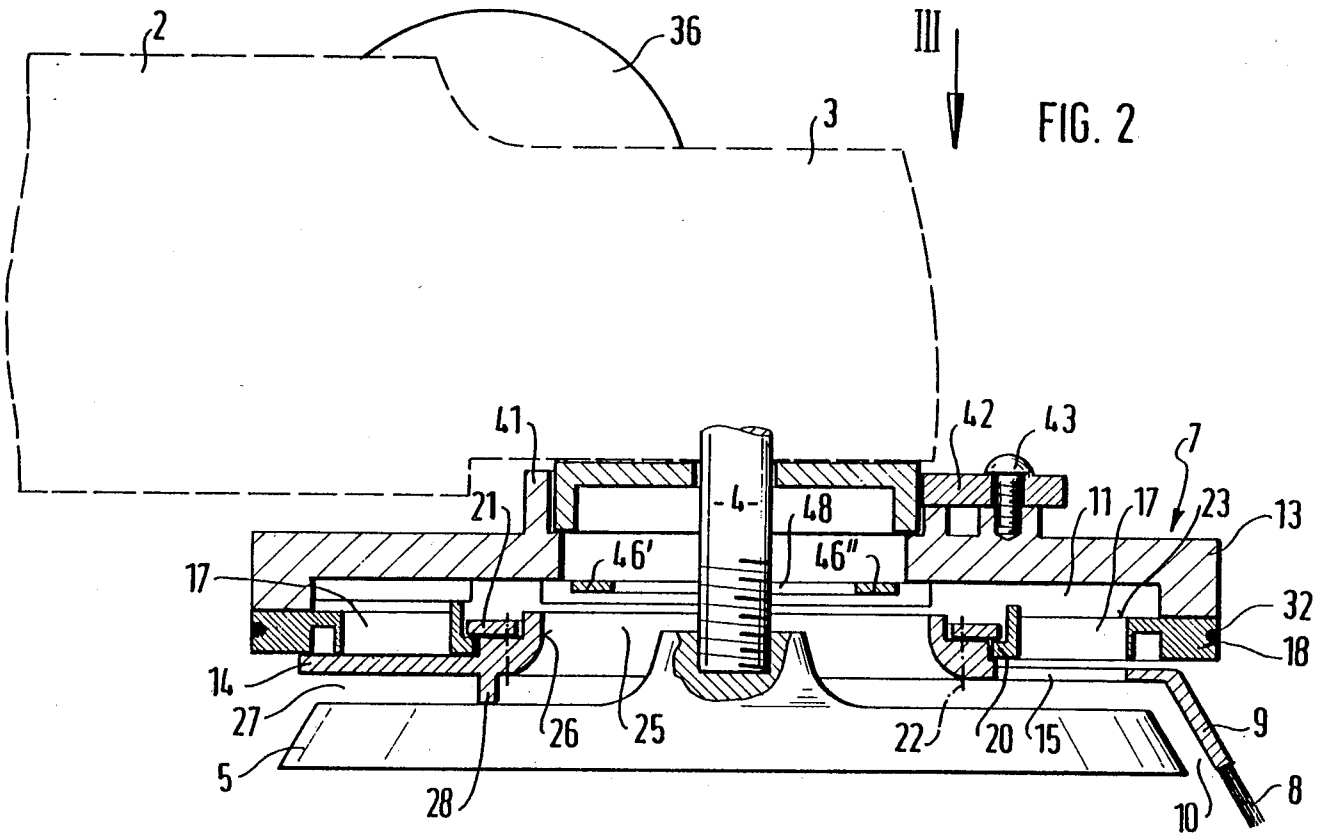
FIG. 2, is a longitudinal cross section of a disk grinding machine pursuant to FIG. 1 which is parallel to the drawing plane.

Referring to the drawings in particular, the invention embodied therein comprises a hand held grinding machine generally designated 1, having a motor handle housing 2, with a machine head 3 having a driving gear for driving a rotatable shaft 4 which carries a rotatable grinding disk 5, which is rotated thereby. In accordance with the invention, the grinding machine includes a suction head generally designated 7, which overlies the grinding disk and includes a rim portion 8, which extends downwardly from the disk and provides a screening area for dust over only a portion of the circumference of the grinding disk.

A disk grinding machine is constructed as a manually operable instrument angle sander instrument 1. An oblong machine casing or handle 1, 1*a*, provides a motor housing 2; 2*a* having a driving motor and a motor head or gear housing 3; 3*a*, in which a right angle driving gear is disposed and out of the lower side of which a driving shaft 4; 4*a* projects in a right angle to the longitudinal direction of the casing The driving shaft rotatably drives a grinding disk 5; 5*a*. The grinding disk 5; 5*a* is composed of a grinding material or is provided with a grinding lining or cover and is generally held obliquely against the work piece to be treated, so that it engages it only over a relatively small angle of circumference.

The angle sander is held with both hands. For one hand a handle 6; 6*a* is provided (FIG. 3) laterally extending from the machine casing 1; 1*a*, attached above the grinding disk 5; 5*a*. By means of this handle 6; 6*a*, the grinding disk 5; 5*a*, can be pressed against the work piece. The other hand can grasp for example the oblong machine casing 1; 1*a*, for which purpose the casing is suitably fashioned as a handle.

In order to prevent, having the grinding dust caused by the grinding, from entering the surrounding environment, an exhauster is provided, which comprises a suction hood 7; 7*a*; covering and space above the upperside of the grinding disk and bridging the circumference of the grinding disk. The hood 7 is provided with a substantially rigid rim screen or bristle rim 8; 8*a* that engages on the work piece at the lower side, or bottom of the grinder 1.

An upper part 13 surrounds the shaft 4 of the grinding disk 5 and a part 9 bridging it towards the lower side supports the bristle rim 8 and defines a circumferentially extending slot 10; 10*a* through which the grinding dust reaches a circulating suction chamber 11; 11*a* in the suction hood 7; 7*a*. At the circumference of the suction hood 7; 7*a* is a dust stud or suction passage 12; 12*a* of a part connected to the housing 1; 1*a*. The passage 12 is in an open connection with the suction chamber 11*a*. An exhauster or a dust bag can be connected to the passage 12; 12*a*. A blower, which is not represented serves for the generation of the suction current. It can be disposed in form of an impeller, affixed to the driving shaft 4; 4*a* and disposed in the suction path.

The bristle rim 8; 8*a*, which rim also comprises a rim of synthetic nubs or a sealing lip made up of flexible material, seals the inner space of the hood at the work piece against the outside, so that the grinding dust cannot reach the outside. However, air from the outside can be drawn in through the bristles, in order to maintain the suction current.

The suction hood 7, 7*a* is attached stationary and to the machine head 3, 3*a* and it is concentric to the driving shaft 4. At the free end of the driving shaft 4; 4*a* the grinding disk 5; 5*a* is attached.

The suction hood 7; 7*a* comprises the upper part 13, 13*a* facing the machine head 3; 3*a*, attached to the machine head 3, 3*a* and the suction chamber 11; 11*a*. The suction space 11; 11*a* is shut off towards the upside and towards the circumference. Towards the lower side, meaning towards the grinding disk 5; 5*a* the suction chamber 11; 11*a* is open.

The suction hood 7, 7*a* also comprises a skirt of lower part 9; 9*a*, which is independent from the grinding disk (5; 5*a*), and which has a connection to the machine casing 1; 1*a*. The bristle rim 8; 8*a* extends solely over a part of the circumference of the lower part, 9; 9*a*, of the suction hood 7 that is suitably over an angle of about 180 degrees or less. The area of the circumference of the lower part 9; 9*a*, which is free from the bristle rim 8; 8*a* defines a visual range or work piece observing area which affords a view of the bristles and the grinding disk 5; 5*a* and the work piece.

The lower part 9; 9*a*, is rotatably supported on the upper part 13; 13*a* and it is rotated when the machine is used, into such a position, that the bristle rim 8, 8*a* is situated in the area of the place of treatment of the work piece, lying next to it. Since the grinding dust enters into the slot 10; 10*a* the slot being substantially tangential in relation to the direction of rotation 16, 16*a* of the grinding disk 5*a*, 5*a*, the bristle rim 8; 8*a* is displaced in relation to the place of treatment towards the rear, seen in direction of rotation 16; 16*a*, so that it starts at the place of treatment in direction of the dust, which is swept slipped away.

Figure 6:
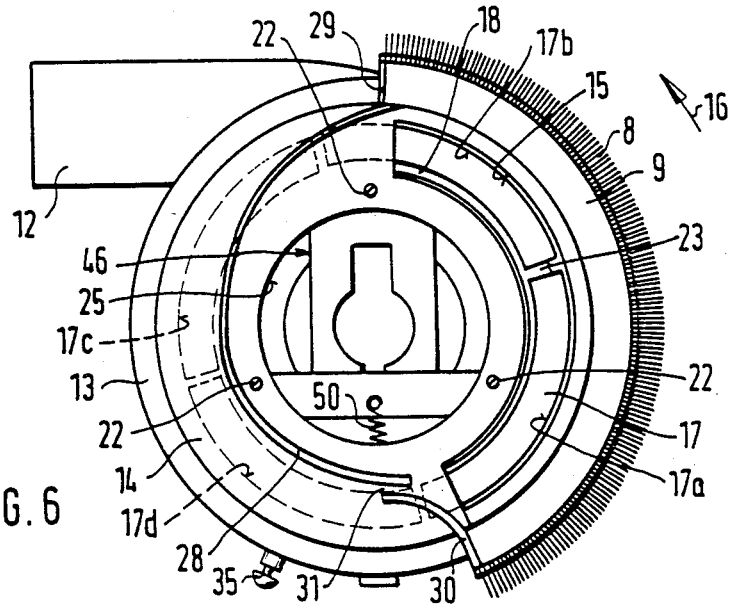
FIG. 6, is an opposite top view seen from below of the suction hood according to FIG. 5.

In the case of the example of embodiment pursuant to FIG. 1 through 6 the lower part of the hood 9 provides a disk body 14, which is disposed opposite to the upper side of the grinding disk, which covers the open lower side of the upper part 13 above it towards the grinding disk 5 The disk body 14 is rotatable and bears the bristle rim 8. In the angle area of the bristle rim 8 the disk body 14 provides an opening 15, through which the grinding dust can reach the upper part 13 and thus the suction chamber 11 It is suitable that the inlet opening 15 in the disk body 14 extends substantially over an angle area corresponding to the angle area of the bristle rim, as shown in FIG. 6 Furthermore the opening 15 can show the form of a partial ring, which runs along the bristle rim 8, or which is angular towards the grinding disk and which supports the bristle rim 8.

The suction chamber 11 is open towards the disk body 14 and through the annular circulating inlet opening 17. The radius of the partial ring which forms the opening 15 corresponds basically to the radius of the annular circulating inlet opening 17. Thus, in each rotation position of the disk body 14 the opening 15 is situated in front of a corresponding area of the circumference of the inlet opening 17 and the rest of the inlet opening 17 is covered.

In the case of the example of embodiment pursuant to FIG. 1 through 6 the lower side of the upper part 13 is formed by a ring bearing 18, which is screwed on at the front side, which projects below the suction chamber 11 from the circumference of the upper part radially towards the inside and which comprises the annular circulating inlet opening 17. At the inner circumference of the ring bearing 18 the disk body 14 (lower part 9) is situated rotatable. At the inner circumference of the ring bearing 18 a bearing set-off, or step 20 is defined, which projects radially towards the inside. This bearing set-off is engaged by a fastening ring 21, which is tightly connected with the disk body 14 by means of screws 22, which are accessible from the grinding disk 5. The fastening ring 21, resting upon the bearing set-off 20, secures the disk body 14 at the same time in an axial direction towards the grinding disk 5. Since the fastening ring 18 projects freely radially towards the inside, the inlet opening 17 is divided into opening segments 17*a*–17*d*, which follow each other in direction of the circumference. The ribs 23 serve to maintain the area of the inner circumference of the bearing ring 18. If above, and in the following, it is a question of the annular circulating inlet opening 17, this includes naturally the division into the opening segments 17*a*–17*d* as well.

The disk body 14 (and thus the lower part of the hood 9) are disposed rotatably and fixed axially. This is true for the embodiment of FIG. 7 through 9, as well as FIGS. 1 through 8. In the case of the examples of embodiment pursuant to the FIGS. 1 through 6, the lower part of the hood 9 is kept down by the bearing set-off 20. The lower part of the hood, lies against bearing ring 18, such that it cannot be shifted towards upwardly.

The disk body 114*a* provides a central opening of passage 25, through which the driving shaft 4 is screwed to the grinding disk 5. The area of the inner circumference 26 of the disk body 114, which limits the outlet of passage 25, projects towards the upper part 13 and forms a centering for the fastening ring 21.

The disk body 14 is disposed at an axial distance to the upper side of the grinding disk 5, so that the grinding dust can reach the opening 15. In order to avoid that over the interspace 27, permits the wrong air to be sucked from the area of the circumference, which is free from the bristle rim 8, it is suitable to provide that at the lower side of the disk body 14 a sealing body or lip 28 is disposed. This body 28 projects towards the grinding disk 5 and seals off the area of the opening 15 at the side opposite of the bristle rim 8 in a plan parallel to the disk body towards the outside. This sealing body 28 is formed suitably by a sealing cross piece. It could be formed by a bristle ledge instead. The represented sealing cross piece is formed in one piece of the disk body 14. Thus, the interspace 27 between the grinding disk 5 and the disk body 14 is closed laterally in the area, in which the opening 16 is situated, so that only through the slot of the circumference 10 at the grinding disk is the grinding dust sucked.

The sealing body 28 runs suitably from the area of one end to the area of the other end of the bristle rim 8, respectively of the angular ledge of the circumference of the lower part, which supports the bristle rim 8, the edge extending around the opening 15. At both ends of the edge of the circumference of the lower part 9, which represents an outer limitation of the slot 10 and which is angular at both ends towards the lower side, sealing body parts 29, 30 can be fastened at the inner side, following the sealing body 28, which seals off against the circumference of the grinding disk.

Furthermore the sealing body 28 can run in a curve around the central area of the disk body and thus also around the driving shaft 4. Dust substances, which are not captured by the opening 15, are slipped in the direction of rotation at the rear end of the bristle rim area against this sealing body in a curved shape and are guided from this end to the front end of the opening of passage.

The sealing body can take a course like a spiral with a radius with tapers in directions of rotation 16 as represented. In order to be able to capture dust particles again, which might come out, the sealing body 28 can form an open inlet (outlet) or passage 31 at the front end, seen in direction of rotation 16, which is open in the direction of rotation. The sealing body 28 is interrupted correspondingly at this place. The opening of passage 31 is adjacent to the front end of the opening of passage 17, so that the dust particles can be sucked by them virtually directly.

Figure 7:
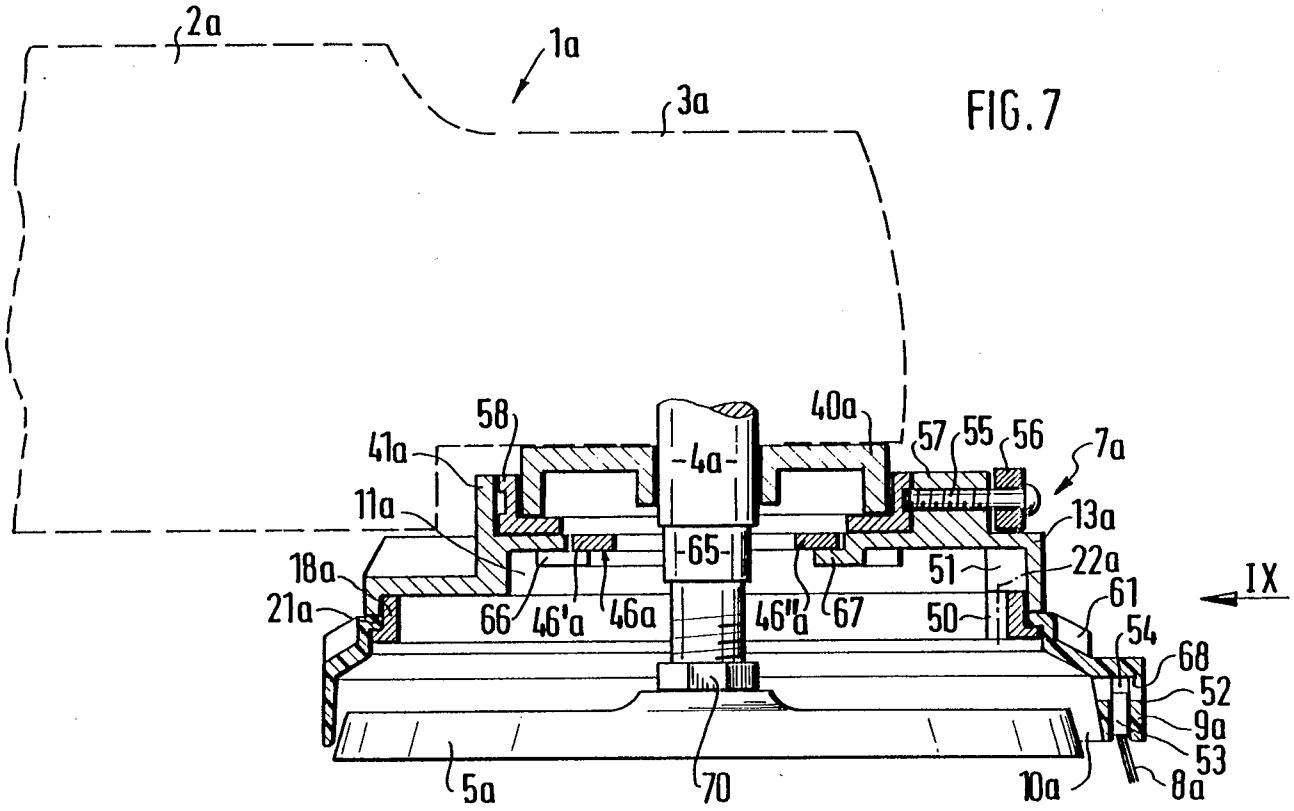
FIG. 7, is a longitudinal cross section pursuant to FIG. 2 of a second embodiment of the inventive disk grinding machine.
Figure 8:
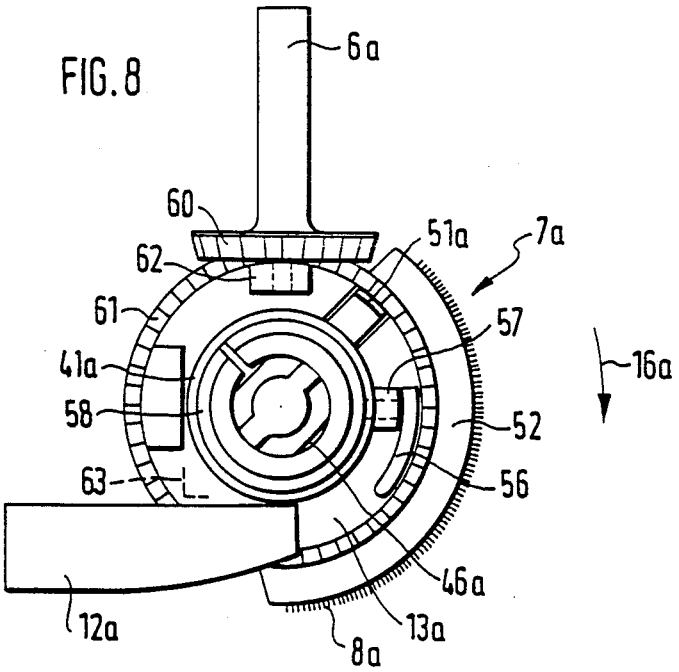
FIG. 8, is a top view of the suction hood of the disk grinding machine pursuant to FIG. 7 corresponding to FIG. 5.
Figure 9:
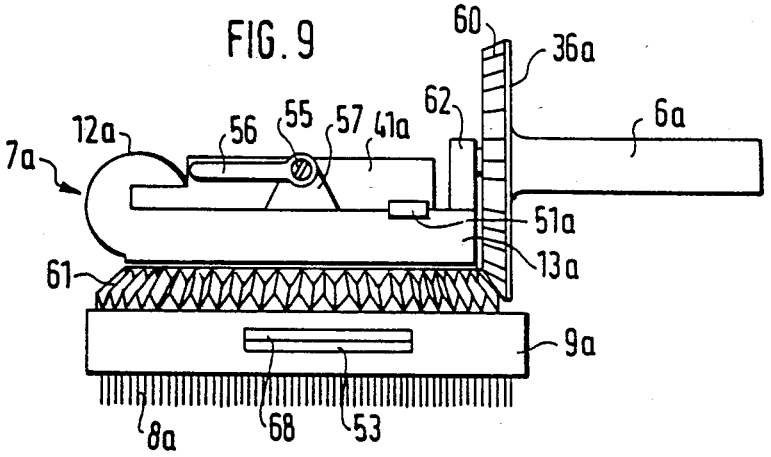
FIG. 9, is a front elevational view of the suction hood of the example of embodiment of FIG. 7 and 8 according to arrow IX in FIG. 7.

In the case of the example of embodiment pursuant to FIG. 7 through 9 the lower part of the hoods 9*a* does not, or only partly extends radially towards the inside into the space between the grinding disk 5*a* and the upper part of the hood 13*a*. Seen in the cross section the wall of the upper part 13*a* turns substantially continuously into the wall of the lower part of the hood 9*a*. The lower part 9 of the hood 7 rests rotating at the lower side of the upper part 13*a* in the area of its outer circumference. For this purpose the disk body 5 is cut short to accommodate the fastening ring 21*a*.

In order to attach rotatably the fastening ring 21*a* of the lower part 9*a*, the fastening ring 9*a* is formed in one piece, and projects radially towards the inside. A bearing ring 18*a* (FIG. 7) with an L-shaped cross-section is provided, which is screwed to the upper part 13*a* by means of screws 22*a*, which are acceptable from the grinding disk 5*a*, the bearing ring 18*a* engaging the fastening ring 21*a*. In the course of this the bearing ring 18*a* engages a little into the upper part 13*a* and lies from inside to the wall of the circumference of the upper part 13*a*. The screws 22*a* of the bearing ring 18*a*, and corresponding forms 51 are screwed in at the inner side of the upper part 13*a*.

In the example of embodiment pursuant to FIG. 7–9 the lower part of the hood 9*a* comprises a circulating rim, embracing the grinding disk. Opposed to this in the example of embodiment pursuant to FIG. 1–6 this rim, which is angular, extends solely over the circumference angle of the bristle rim. However, in both embodiments both variations are possible, the variation with the circulating rim providing the advantage that dust particles can be captured all around. In the course of this the circulating rim replaces the sealing body 28 of the example of embodiment pursuant to the FIG. 1–6. The circulating rim ends a little above the rear side of the grinding disk 5*a*, so that its lower circumference edge is free. A marginal part 52, bearing the bristle rim 8*a* is displaced radially towards the front in relation to the rest of the marginal area, as seen from FIG. 7 and 8, so that here a slot 10*a* is formed, the rest of the marginal area being adjacent to the circumference of the grinding disk.

Furthermore, a portion of the bristle rim 8a may be tapered radially inwardly in direction of rotation 16a. Accordingly, the marginal part 52, which supports the bristle rim is also tapered. The dust particles are slipped into the bristle rim 10a at its wider end. This can be provided as well in the case of the example of embodiment pursuant to the FIG 1–6.

The bristle rim 8a can be fashioned by a bristle ledge 53, which possesses a ledge body 54, inserted into an annular tee-shaped slot of the lower part 9a, the bristles spreading away from the ledge body. When the bristles are used up, the bristle ledge 53 can be exchanged very easily. This can be provided in the case of the example of embodiment of FIG. 1–6 as well.

In the arrangement according to FIG. 7–9, a disk body corresponding to the disk body 14 of the example of embodiment pursuant to FIG. 1–6 can be provided at the lower part of the hood, as well as in the arrangement pursuant to the FIGS. 1–6 the lower part of the hood can repose at the outer circumference of the rear side of the upper part.

In the two examples of embodiment the upper part 13; 13a provides basically the shape of a flat box, which is open towards the grinding disk 5; 5a, which in the case of the example of embodiment pursuant to FIG. 1–6 is covered by the disk body 14.

Furthermore in the suction hood 7, 7a is an accessory part, disposed between the grinding disk 5; 5a and the machine casing 1; 1a and is attached releasable at the machine casing. Thus the suction hood 7 can be removed entirely, especially if such places of work pieces are treated, in which the suction hood might be hindering for reason of lack of space, or in which the grinding disk should be visible all-around. Besides a machine, which does not provide a suction hood, can be equipped with one subsequently.

At the lower side of the head of the casing 3; 3a a cylindrical overhang; 40a of the housing projects coaxially to the driving shaft 4; 4a. The upper part 13; 13a of the suction hood can be plugged on this overhand of the casing 40; 40a, since the upper part 13, 13a provides a correspondingly cylindrical tubing apparatus 41; 41a. The upper part of the hood 13; 13a and the entire suction hood With it can be clamped to the overhand of the casing 40; 40a.

For this purpose in the example of embodiment pursuant to the FIGS. 1–6 an eccentric lever 42 is provided, which is operated by hand. The eccentric lever 42 is attached to the upper part 13 by a swiveling axis 43, which runs parallel to the driving shaft 4 and reaches with its clamp end through the adapter socket 41, which is interrupted here. The clamp end is fashioned as an eccentric so that by pivoting the eccentric lever 42, its clamping part is clamped against the overhand of the housing 40, so that the upper part 13 and entire suction hood 7 with it is fastened. The eccentric lever 42 sits in front of the machine head 3 on the upper side of the upper part 13 and thus is easily accessible. Its lever arm, which is to be grasped by hand projects to one side.

In the embodiment pursuant to FIG. 7–9 a clamping screw 55, screwed radially through the upper part of the hood 13a is provided, which carries an operating lever 56 in order to render the twisting easier and which presses by its front face against the projection of the housing 40a. In order to receive the clamping screw 55, the upper part of the hood 13a provides at its upper side an elevation 57.

At any rate a slotted spacer 58 can be assigned to the insert-opening of the upper part of the hood 13; 13a, formed by the plug-in-socket 41; 41a for the adaption to the diameter of the projection of the housing 40; 40a. The spacer can be clamped against the projection of the housing 40; 40a. This is shown only in the case of the variation pursuant to the FIGS. 7–9. In this way for machines with projections of the housing 40; 40a with different diameters the same suction hood can be used, by inserting the corresponding spacer 58 into the plug-in-socket 41. Then the clamping screw 55 presses against the slotted spacer 58, so that the latter is clamped against the projection of the housing 40a. When the eccentric lever 41 issued, corresponding conditions are valid.

In order to avoid that the lower part 9; 9a has to be touched for turning it, a driving device is assigned to it. For this purpose the handle 6; 6a, is fashioned as a turning handle, which is in a driving connection with the lower part of the hood 9; 9a over a drive. Thus the handle 6, which is directed cross-wise to the driving shaft 4; 4a of the grinding disk 5; 5a and which has an oblong shape can be turned around its own axis, the lower part of the hood 9; 9a and the bristle rim 8; 8a turns with it. In this way the hand, holding the handle 6a can bring the bristle rim to the most suitable place for the dust suction during the grinding treatment.

Figure 3:
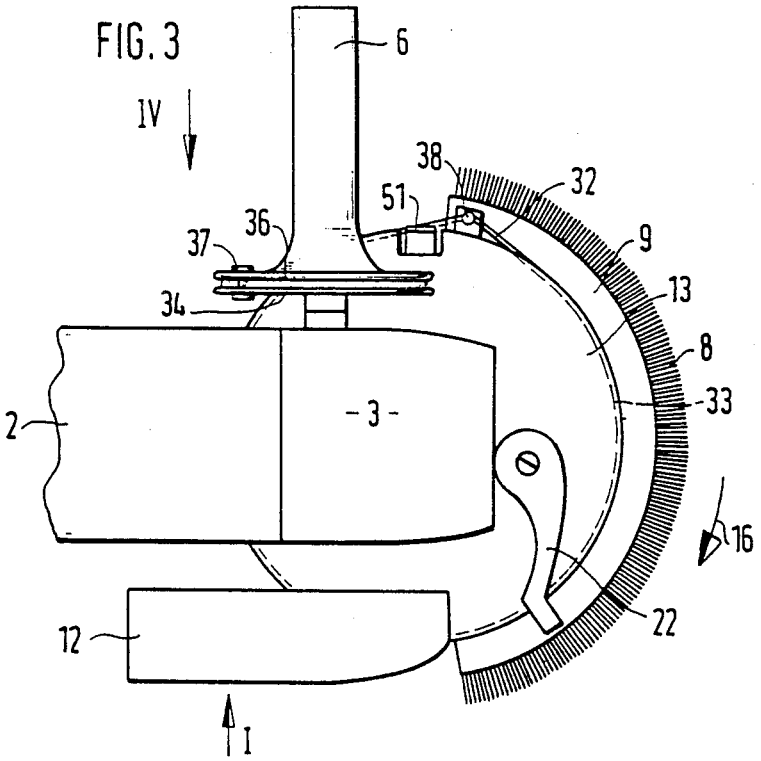
FIG. 3, is a top planar view of the disk grinding machine taken from above in the direction indicated by the arrow III in FIG. 2.
Figure 4:
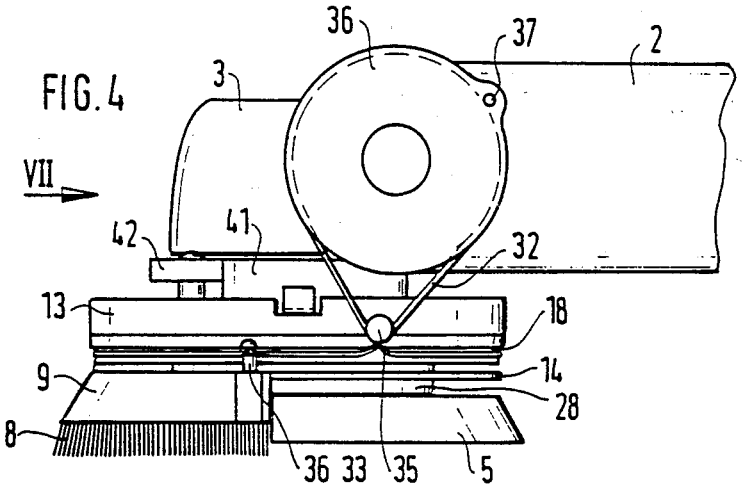
FIG. 4, is an opposite side elevational view of FIG. 1 (arrow IV in FIG. 3) of the disk grinding machine.
Figure 5:
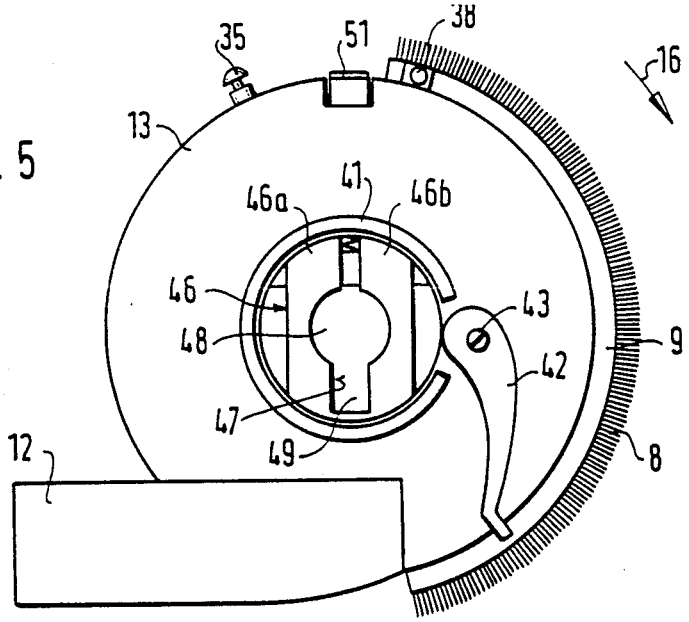
FIG. 5, is a top planar view of the suction hood in a separate representation according to arrow V in FIG. 1.

The drive can be a rope- or a belt drive (FIGS. 3 and 4). In the case of the rope-drive of the example of embodiment pursuant to the FIGS. 1–6 the lower part of the hoods 9 is in a driving connection with the control grip 6 over a cable control 32. This cable control 32 (FIG. 2) is formed by a rope, which runs similar to a double loop in the form of an eight, the individual loops 33, 34 of which are disposed in a right angle to each other. The one of the individual loops 33 is lead at the circumference of the upper part of the hood 13 and is attached to the lower part 9 of the hood 9, while the other individual loops 33, 34 turning into each other at a deflection [guiding]device 35, for example a roller or a deflecting bolt, disposed at the upper part of the hood 13. The control grip 6 provides at its end facing the machine head a driving disk 36 with a bigger diameter compared to the handles 6, at the circumference of which the cable control is attached at 37, the individual loop 34 of which runs in a circumferential groove of the driving disk 36. The deflection installation 35 is placed below the control grip 6 at the upper part 13, that is in such a way, that the rope, deflected at the deflection installation is disposed at both sides of the deflection installation 35 at the height of a circumferential groove provided at the lower part of the hood 9, in which the individual loop 33 is lead. For fastening the rope at the lower part of the hood 9 at the outer side of the hood, a rope holder 38 is provided which extends over the heights of the circumferential groove of the upper part 13, which leads the individual loop 33 of the cable control. If the control grip 6 is turned into one direction, or the other, the rope, which is attached at 37 at the control grip is taken along. In the course of this the lower individual loop 33 slips out of place in the circumferential groove of the upper part of the hood and at the same time takes along the disk body 14 (9) over the rope holder 38.

In the embodiment pursuant to FIG. 7 through 9 the drive is a toothed gearing. The control grip 6a bears a coaxial cog wheel, or level gear, 60 at its end area, opposite of the free grip end, the cog wheel being engaged with a gear rim 61, which is disposed at the lower part of the hood 9*a*. In a similar way as the control grip 6, the control grip 6*a* provides a radially projecting drive disk 36*a*, at the side, opposite to the free grip end of which the cog wheel 60 is disposed, the teeth of which are at the circumference of the drive disk 36*a*. In the case of this example of embodiment it is a conical cog wheel or bevel gear. The lower part of the hood 9*a* projects in a radial direction over the upper part of the hood 13*a* and support at the projecting area the gear rim 61. The gear rim 61 is disposed at the upper side of the projecting area of the upper part of the hood 9*a*. Thus the lower part of the hood 9*a* turns through underneath the cog wheel 60, when the control grip 6*a* is turned. In the case of the example of embodiment the cog wheel 60 and the gear rim 61 are formed in one piece to the control grip 6, respectively to the lower part of the hood 9*a*, however in the principle they could be individual pieces as well, attached in the corresponding way.

A further possibility to conceive the rotary drive would be a bendable [flexible]shaft between the control grip and the lower part of the hood.

In the case of the example of embodiment pursuant to the FIG. 1–6 the control grip 6 is disposed at the machine head 3. However, it is suitable, as represented in the example of embodiment pursuant to FIG. 7–9, that the control grip 6*a* is disposed at the upper part 13 of the hood 13*a*. Then the suction hood and the rotary drive of the lower part of the hood and of the control grip can be entirely pre-fabricated and then be fastened entirely to the machine head.

If it is a question of a relatively flat upper part of the hood 13*a*, as it is the case in the example of embodiment, a lever-supporting element 62 can project from the upper side of the upper part of the hood 13*a* in the area of the circumference of the control grip 6*a*, in order to dispose the control grip 6*a* in a rotary bearing. Then there is enough space for seizing the control grip 6*a* with the hand.

In FIG. 7 the control grip 6*a* and the cog wheel 60 is disposed below the drawing plane and therefore are covered by the housing of the machine 1*a*.

Figure 10:
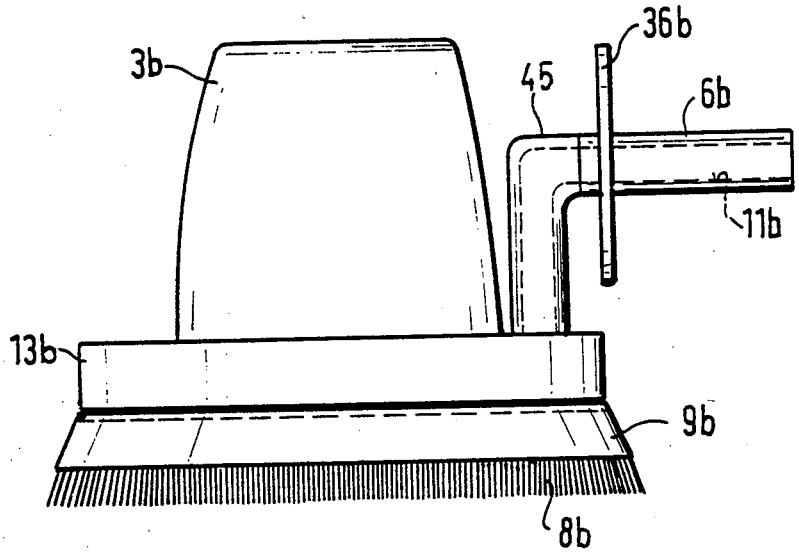
FIG. 10, is a front elevational view of the schematic representation of the further variation of the inventive disk grinding machine according to arrow VII in FIG. 4 or arrow IX in FIG. 7.

A variation of the control grip, disposed at the upper part of the hood is to be concluded from the scheme, represented in FIG. 10. This control grip 6*b* is disposed above the upper part of the hood 13*b*. Therefore from the upper part 13*b* a control grip-supporting element 45 projects. Between this control grip-supporting element and the control grip 6*b* a pivot bearing is disposed At the control grip 6*b* a driving shaft 36*b* is provided with a cog wheel.

For a better comprehension the lower part of the hood 9*b*, the bristle rim 8*b* and the machine head 3*b* are numbered for reference in FIG. 10. In the example of embodiment pursuant to the FIGS. 1–9, as already mentioned, a dust suction socket 12; 12*a* is formed to the upper part of the hood 13; 13*a*. The dust suction socket is connected with the suction chamber 11; 11*a*. This dust suction socket 12 can project tangentially from the circumference of the upper part of the hood 13; 13*a*, being disposed suitably at the opposite side of the control grip 6; 6*a* of the upper part of hood 13, 13*a*, so that it, the dust suction socket 12; 12*a*, is turned away from the hand, which is holding the control grip 6; 6*a*. In order to prevent the suction socket 12; 12*a* from hindering the suction hood to be fastened to the machine, the arrangement can be conceived in such a way, that the suction socket 12; 12*a* does not project towards the upper side over the upper part of the hood 13; 13*a*. In the upper part of the hood 13; 13*a* a dust guiding plate 63 is advantageously disposed in the area of the mouthing of the dust suction channel, the plate preventing the dust from being slipped past the mouthing. The plate extends from the upperside of the upper part of the hood 13; 13*a* in the suction chamber 11; 11*a* to the grinding disk 5; 5*a*. The plate, deviating the dust 63 or something of that kind is indicated by the dotted line in FIG. 8. It is formed to the lower side of the upper part, which is not visible here.

The dust suction could be carried from the suction chamber to the outside by a suction channel 11*b*, which penetrates the control grip 6*b* in lieu of the socket 12; 12*a* (FIG. 10).

In the case of the version pursuant to the FIG. 10 the suction channel 11*b*, and thus the control grip 6*b* runs in the supporting element 45 and eventually through the upperside of the upper part of the hood 13*b* into the suction chamber, which is in the upper part of the hood 13*b*.

In order to render it easier to attach or release the grinding disk 5; 5*a* to or from the driving shaft 4; 4*a*, the driving shaft can be locked. For this purpose in the inner side of the upper part of the hood 13; 13*a* an arresting plate 46; 46*a*, which can be operated from outside and which is spring loaded is lead cross wise to the driving shaft 4; 4*a*, being slidable to and fro. It embraces the driving shaft 4; 4*a* in its active position and holds it stiff against rotation. The represented arresting plate 46, 46*a* provides a furcated slot 47 (see FIG. 5), which provides an area 48 with a bigger diameter than the driving shaft 4 and an area 49 with a diameter, which locks the driving shaft. In the course of the ordinary functioning of the machine this arresting plate 46; 46*a* is in the position, in which the driving shaft 4; 4*a* penetrates the area of the furcated slot 48 which has a bigger diameter If the driving shaft should be locked in order to exchange the grinding disk, the arresting plate is displaced, so that area 49 of the furcated slot 47 comes onto the driving shaft 4; 4*a* and thus the driving shaft 4; 4*a* is arrested. The arms of the fork 46', 46''; 46'*a*, 46''*a*, running at both sides of the driving shaft can be seen in FIG. 2 and 7. Since the arresting plate 46*a* of the example of embodiment pursuant to FIG. 7–9 can correspond to the arresting plate 46, no reference numbers have been put to their details in FIG. 8.

In the height of the arresting plate the driving shaft provides flattenings for attaching the arms of the forks. This part of the driving shaft is represented at 65 in FIG. 7.

The arresting plate 46; 46*a* is disposed displaceable to and fro at bearing cross pieces, which are disposed suitably in the upper part 13; 13*a*. Two of these bearing cross pieces 66, 67 are indicated in FIG. 7. Furthermore they are spring-loaded. For this purpose there is a spring 50 which is connected to the arresting plate 46; 46*a* against the force of the spring 50.

Furthermore it is suitable, that the lower part of the hood 9;9*a* provides at the circumference a perforation 68 (see FIG. 9) for the trans-grid action of a tool, which comes into action with the grinding disk, which is screwed onto the driving shaft and can be released, the driving shaft being locked. In FIG. 9 this perforation 68, in the shape of a slot, is provided at the edge of the circumference of the lower part of the hood, which projects towards the lower side and in the area of the bristle rim 53, which is visible here in parts through the perforation 68.

In the height of the perforation 68 at the upper side of the grinding disk a firmly disposed nut 70 is sitting, into which the driving shaft is screwed and with which the tool comes into action.

In principle the suction hood could be a machined piece for example by providing that the upper part of the hood is attached to the housing in one piece by connection. However, it can be seen, that a releasable attached suction hood is more suitable.

While specific embodiments of the invention have been shown and described in detail to illustrate the application of the principals of the invention, it will be understood that the invention may be embodied otherwise without departing from such principals.

What is claimed is:

1. A disk grinding machine, comprising a casing, a drive motor having a rotatable driving shaft disposed in said casing, a grinding disk connected to said driving shaft and driven into rotation by said driving shaft, a dust exhauster having a suction hood attached to said casing overlying and covering said grinding disk, said suction hood being spaced above and outwardly of the periphery of said grinding disk and defining a suction chamber, said suction hood having a downwardly extending rim portion defining a dust screening area extending over only a portion of the circumference of said disk and leaving a visual range part free around said disk and defining means for the sucking up of dust between the circumference of the grinding disk and said rim portion, said suction hood including an upper portion secured to said casing and a lower portion which is rotatable independently of said grinding disk, said rim portion being attached to said lower portion, a rotatable extension handle extending outwardly from said casing, an interengagement means interengaging said suction hood lower portion with said extension handle and effecting the rotation of said lower portion corresponding to the rotation of said extension handle.

2. A disk grinding machine according to claim 1, wherein said extension handle includes a portion having a driving gear connected thereto, said suction hood lower portion having a driven gear engaged with said driving gear and being rotatable upon rotation of said extension handle.

3. A disk grinding machine according to claim 2, wherein said extension handle comprises a control grip having said driving gear at one ned thereof, and having an opposite end with a free hand grip, said suction hood having a lower part with an angular gear rim defining said driven gear.

4. A disk grinding machine according to claim 3, wherein said gear rim is disposed at the upper side of a projecting area of said lower part.

5. A disk grinding machine according to claim 1, wherein said interengagement means comprises a rope or belt gear having a double loop in a super-phantom-circuit with individual loops disposed in a right angle to each other, one individual loop being directed along the circumference of said upper part of said suction hood and being attached to the lower portion of said suction hood, and the other individual loop wrapping around the circumference of said control handle and being attached to it, both loops passing over into each other at a deflection device disposed in the upper part of said suction hood.

6. A disk grinding machine according to claim 1, wherein aid upper portion includes a dust suction socket, having an interior forming a suction chamber including said dust suction socket.

7. A disk grinding machine according to claim 1, wherein said suction hood includes an dust suction socket connected to said upper portion, said dust screening area being spread tangentially away from the circumference of the upper portion of said suction hood.

8. A disk grinding machine according to claim 6 wherein said suction hood includes bearing ring between said upper and lower portions having an opening in alignment with an opening of said lower portion, for the passage of dust therethrough communicating with said suction socket.

9. A disk grinding machine according to claim 1, wherein said upper portion of the hood includes a collar which can be clamped onto a cylindrical projection of said handle.

10. A disk grinding machine according to claim 9, a slotted insertion ring is assigned to said plug-in opening of said upper part of said suction hood for the adaption of the diameter of said projection of said housing said insertion ring being clamped against said projection of said housing.

11. A disk grinding machine according to claim 9 wherein the upper part of said hood provides the form of a plane plug socket, comprising at its upper side a cylindrical slip-on jacket.

12. A disk grinding machine according to claim 1, wherein the upper part of the hood includes a locking driving for arresting said driven shaft against rotation.

13. A disk grinding machine according to claim 1, wherein said grinding disk is threadably engaged to said driving shaft, and said suction hood provides a perforation at a hood circumference for penetration of a tool said tool moving with said driving shaft, said tool locking said driving shaft to provide disengagement of said grinding disk from said driving shaft.

14. A disk grinding machine according to claim 1, wherein said bristle rim extends over an angle area of about 180 degrees or less.

15. A disk grinding machine according to claim 1, wherein said bristle rim is formed by a ledge inserted into said lower portion of the suction hood.

16. A disk grinding machine pursuant to claim 13, including an opening which extends over an angle area, corresponding substantially to said dust screening area.

17. A disk grinding machine according to claim 1, wherein said rim is a bristle rim.

* * * * *